US007416184B2

(12) United States Patent
Ferrara

(10) Patent No.: US 7,416,184 B2
(45) Date of Patent: Aug. 26, 2008

(54) SHEET BUFFER DEVICE WITH ROTATING DISK

(75) Inventor: Joseph J. Ferrara, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 243 days.

(21) Appl. No.: 11/372,288

(22) Filed: Mar. 9, 2006

(65) Prior Publication Data

US 2007/0210511 A1 Sep. 13, 2007

(51) Int. Cl.
*B65H 5/00* (2006.01)

(52) U.S. Cl. ..... 271/264; 271/275; 271/307; 271/311; 271/312

(58) Field of Classification Search ..... 271/264, 271/275, 303, 307, 311, 312

See application file for complete search history.

(56) References Cited

U.S. PATENT DOCUMENTS

| | | | | |
|---|---|---|---|---|
| 4,925,179 | A * | 5/1990 | Breton et al. | 271/187 |
| 5,207,412 | A * | 5/1993 | Coons et al. | 270/1.02 |
| 6,205,924 | B1 * | 3/2001 | Kamano | 101/477 |
| 6,554,216 | B1 * | 4/2003 | Escobedo et al. | 242/270 |
| 6,965,458 | B2 * | 11/2005 | Sato et al. | 358/401 |
| 7,192,020 | B2 * | 3/2007 | Hayashi et al. | 270/58.11 |
| 2004/0251620 | A1 * | 12/2004 | Goldbeck | 271/275 |

* cited by examiner

*Primary Examiner*—Patrick Mackey
*Assistant Examiner*—Prasad V Gokhale
(74) *Attorney, Agent, or Firm*—James J. Ralabate

(57) ABSTRACT

A paper or sheet buffering system is provided which avoids having to shut down the entire system when the paper path or transport is overloaded. A rotating disk having an attached collection and dispensing finger(s) is used to pull excess sheets off the transport and hold them until it is suitable to dispense them back on to the transport.

5 Claims, 12 Drawing Sheets

SHEET BUFFER DEVICE WITH ROTATING DISK

FIELD

This invention relates to an electrostatic and other marking systems, and more specifically, to paper handling functions in these systems.

BACKGROUND

Generally, in a commercial electrostatographic reproduction or marking apparatus (such as copier/duplicators, printers, or the like), a latent image charge pattern is formed on a uniformly charged photoconductive or dielectric member. Pigmented marking particles (toner) are attracted to the latent image charge pattern to develop such image on the dielectric member. A receiver member, such as paper, is then brought into contact with the dielectric member and an electric field applied to transfer the marking particle developed image to the receiver member from the dielectric member. After transfer, the receiver member or paper bearing the transferred image is transported away from the dielectric member and the image if fixed or fused to the receiver member by heat and/or pressure to form a permanent reproduction thereon. This permanently marked paper in some systems is then passed to a finishing station where the papers are stacked and stapled or compiled into a book or binder. Proper paper handling in this type system becomes vital to proper functioning of these marking systems. With the advent of high speed electrostatic and other marking systems, printers can produce at a rate in excess of seven thousand copies per hour. Copies in some systems are each fed to the finishing station at a rate of 0.5 seconds per sheet providing a 0.5 second time between copies. If the stapler is functioning at a slower rate, papers or copies in the paper feed path need to be attended to in order to prevent paper jams and other system breakdowns.

Methods used to control this problem include stopping the feed system until the stapler (or other finisher) catches up to the backlog of papers or by buffering the sheets. "Buffering" includes diverting the excess backlogged sheets on the main paper path to some other detour paper path to be held in this detour and to be fed back into the main paper path when the excess or backlog papers can be properly handled by the stapler or binder at the compiler or finishing station. Thus, a production loss in many finishing devices is attributed to a skipped pitch (or pitches) required to allow the stapler function and a set ejection out of the staple head function to occur. This above noted prior art buffering method utilizes a long paper path in which sheets can be accelerated and timed such that a sufficient gap can be produced to allow time for these functions. This is costly and complex. In addition, in today's technology, copier or printer space is at a premium and their structures are compact, leaving very little extra space for a long detour paper path. Sheets and mechanisms are often moved at velocities and accelerations that are faster than desired. Again, this can lead to higher jam rates and more frequent hardware failure rates which negatively impact customer-user satisfaction. There is a need for a paper handling system that will not require stopping the system or using a space occupying long paper path. The prior art systems using long paper auxiliary or detour path are time consuming, take up valuable space, are costly, not very reliable and require a separate motor.

SUMMARY

The present embodiments provide a reliable and space saving solution to the above problems. These embodiments provide a rotating disk with fingers sheet buffer in an operative arrangement with the paper transport in the paper path. This disk element can buffer one or several sheets. No excessive sheet accelerations are required, and system shut down is avoided. This disk element parks in an inert position while most sheets travel in a paper path within a finishing set or module or in a separate module before a finishing station. When sheet buffering is required, the disk is rotated to a load position where the fingers will collect excess sheets. The disk rotates at the paper speed and escorts the collected sheets out of the main paper path. This is repeated for as many sheets required to create a downstream shipped pitches with no skip in the upstream path. The set of buffered sheets are released to the main paper path when required. One or several collection fingers are positioned on the rotating disks, these fingers are skewed to collect papers from the main paper path when the disk is in the load position, and these fingers are enabled to release these collected papers when the disk is rotated to a release position. A movable gate is located in proximity to the main paper path to block this path when the disk is in the load position and to open this path when the disk is in the release position.

DETAILED DESCRIPTION OF DRAWINGS AND PREFERRED EMBODIMENTS

Figure 1:
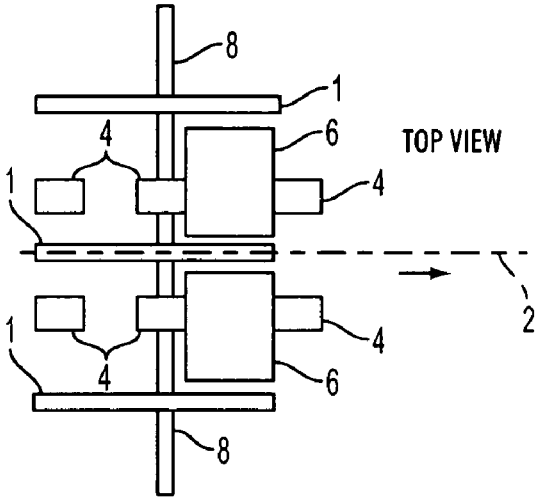
FIG. 1 illustrates top view of the paper handling systems in the present embodiments.
Figure 2:
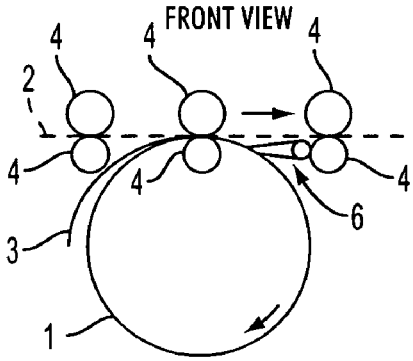
FIG. 2 illustrates a front view of the paper handling system in the present embodiments when the disk finger and gate are in the insert position.
Figure 3:
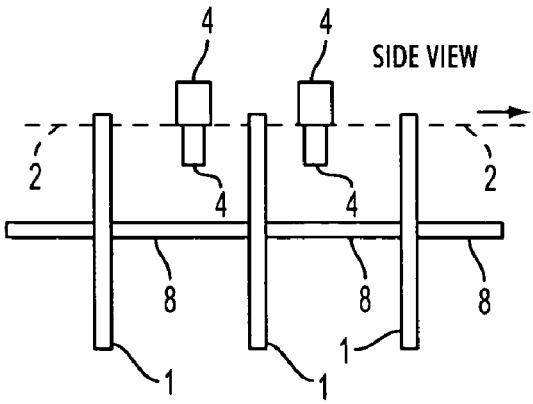
FIG. 3 illustrates a side view of the paper handling system in the present embodiments, the gate and disk finger are in the inactive positions.

In FIGS. 1, 2 and 3 a top, front and side view, respectively, of an embodiment is illustrated in this paper handling system. In the front view of FIG. 2, a rotating disk 1 is positioned below a paper transport or path 2 and in an operative relationship thereto. The disk 1 is in an inert position with disk fingers 3 shown in FIG. 2 extending and pointing away from the paper path and transport 2. Above and below the paper path or transport 2 in FIG. 2 are located drive rollers and idlers 4 which contact the paper 5 (see FIG. 5) and drive it along the paper transport or path 2 when in a drive mode. The direction of this drive path 2 is indicated by the arrows. A movable gate 6 is located adjacent the drive path 2 and is enabled to both block the entrance to drive path 2 or to open the entrance to drive path 2. Gate 6 blocks the entrance when the system is in the buffering (or active) mode and opens the entrance (inactive position) when the system is in the release or unloading mode. The drive rollers 4 in FIG. 2 are shown in contact with the drive path 2 and ultimately with paper 5 but are movable to a position out of contact with the path during the buffering mode so that no paper movement occurs on the paper path 2. Disk shaft is shown at 8 in FIG. 3. A movable gate 6 is shown in FIGS. 1 and 2 in the bypass position where the entrance to paper transport or path 2 is open. Any number of disks 1 may be used in the present embodiments.

After the inactive position shown in FIGS. 1 and 3, the disk 1 is rotated into the buffering position (see later FIG. 7). The diverter gate 6 is moved into position using a solenoid and linkage or by other similar means. The nip at the buffer entrance is opened also by solenoid. This activity occurs during the inter-document gap time between the last sheet 5 traveling down the paper path 2 and the first sheet 5 to be buffered.

The top view in FIG. 1 looks down on the paper path 2. There are three disk drive shafts 8 with elastomer drive rolls 4 and opposing plastic idlers 4 creating drive nips. Motors will drive the drive shafts 8. A sheet or sheets of paper 5 will travel down the paper path 2 from left to right in this top view of FIG. 1. The Front View in FIG. 2 looks into the paper path 2 in the axial direction of the drive elements. In this view, one can clearly see the three drive rolls and the idlers 4. A dashed line represents the paper path 2. Baffles are not shown for clarity, but are implied. In the paper path 2 is a diverter gate 6. In the nominal state the gate 6 is closed as shown and paper 5 (see FIG. 5) travels through to the paper path 2. The second element below the paper path 2 is a disk shaft 8.

The disk shaft in the embodiment of FIG. 1 consists of a metal shaft 8 which is driven by a suitable motor. The shaft 8 in this embodiment, as above noted, has three disks 1. This specific embodiment has disks 1 approximately 6 inches or about 150 mm in diameter. This will allow paper sheets 5 of sizes about 18 inches to be buffered. The disks 1 have one finger 3 each, and the finger 3 has an integral leaf spring.

The following FIGS. 4-13 represent the functional description of the system paper path and transport 2. The system view of FIGS. 5, 7, 9, 11 and 13 represents the flow of sheets 5 through the printer transports 2, stopped or through the buffer and ultimately into the finishing station 7. The buffer is represented in three figures by the buffer finger disk 3, the gate 6 and some transport nips. Assume the rest of the paper path 2 would have drive nips also, but these are not shown for clarity. The finishing station 7 (of FIGS. 5, 7, 9, 11 and 13) is represented by the notched rectangle symbolizing a stapler and by an angled line below symbolizing the output stacking tray. Also in FIGS. 5, 7, 9, 11 and 13 the sheets 5 are represented by the solid lines. The paper transport or path 2 is denoted by the dashed line.

Figure 4:
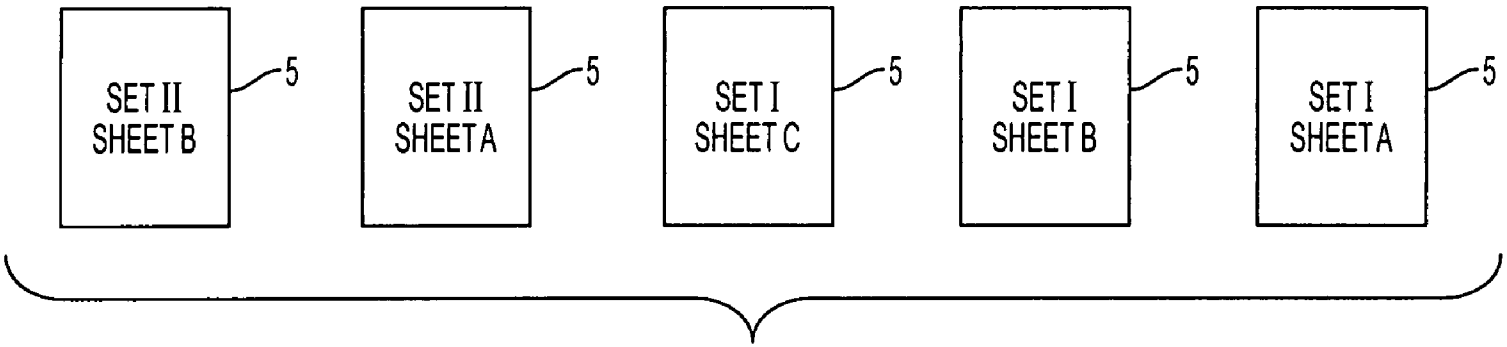
FIG. 4 illustrates a top view of the sheets of set I and set II traveling on paper transport system to be stapled or finished at the finishing station located at the end of the system.
Figure 5:
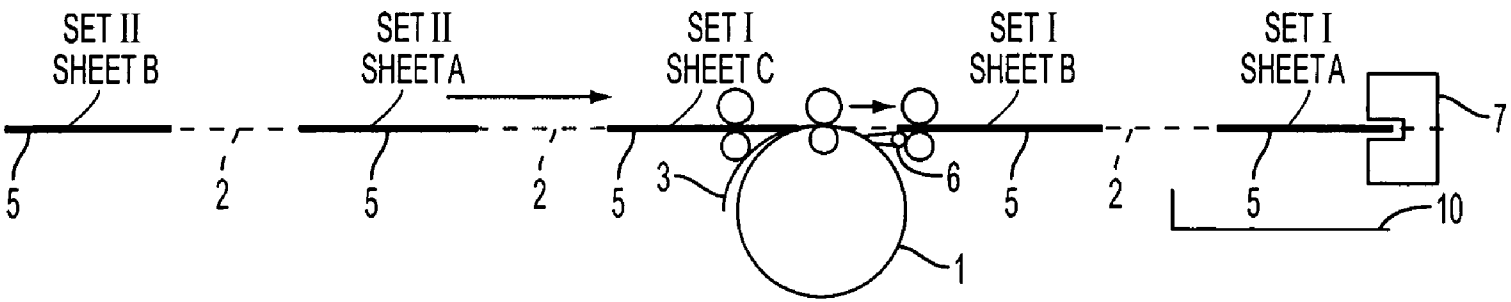
FIG. 5 illustrates a side view of the sheets shown in FIG. 4 traveling on paper transport system, the gate and disk finger are in the inactive positions.

The view of FIG. 5, for example, shows sheets of paper 5, as shown in FIG. 4, flowing down the paper path 2 in a standard cadence. For a 120 print per minute printer, each lead edge to next lead edge time is 0.500 seconds. The series of FIG. 5 define snap shots in time. "In the buffer" means the paper 5 is being diverted from the paper path 2 and wound around disk 1.

Each FIG. 4-13 illustrates a job that consists of three sheets A-C per sets I, II and III. The flow of sheets 5 is shown with the sheets 5 and sets identified along the paper path 2.

In FIGS. 4 and 5, sheets A and B of Set I (as illustrated in FIG. 4) are being forwarded to be compiled in the finishing or stapler area 7. Both the disk fingers 3 and gate 6 are in the inactive positions with paper 5 freely traveling on path or transport 2. The open end of finger 3 points downward and gate 6 is positioned below the path 2 in a non-blocking position allowing paper 5 of both set I and set II to travel along path 2. The gate 6 and finger 3 are both in the inactive position in FIG. 5. Sheets A and B of set I are already approaching the finishing station 7.

Figure 6:
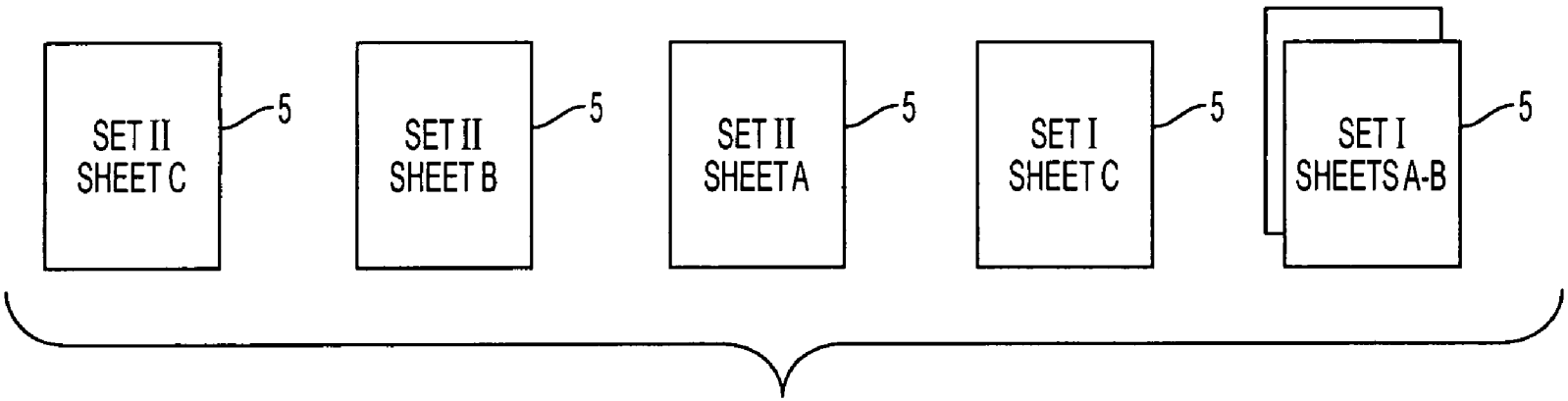
FIG. 6 illustrates a top view.
Figure 7:
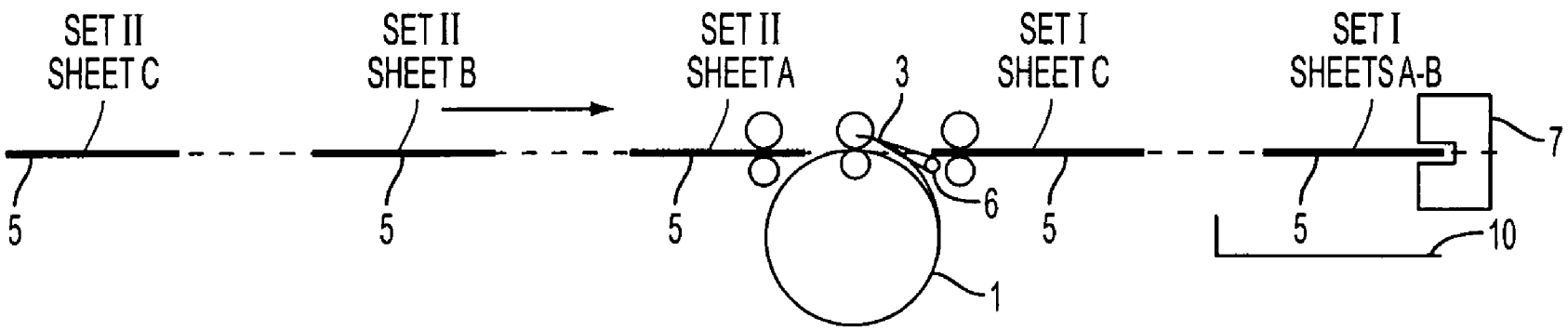
FIG. 7 illustrates a side view where all sheets of set I are in or approaching the finishing station, while sheets of set II are being buffered. The gate and disk finger are in the active positions.

Once it is determined that sheet feeding needs to be delayed or buffered, FIG. 7 illustrates the buffering of set II sheets. These sheets 5, as in the sequence of FIG. 6, are driven into finger 3 opened end while gate 6 blocks access to the paper path 2. Both the finger 3 and gate 6 are now in their active positions; that is, they are delaying set II, until the finishing station 7 is ready to accept set II papers. Sheets A-C of set I are being forwarded to be compiled in the stapler area 7. Sheet A of set II is approaching the buffer and sheet A of set II is about to enter the finger 3 of the disk 1.

Figure 8:
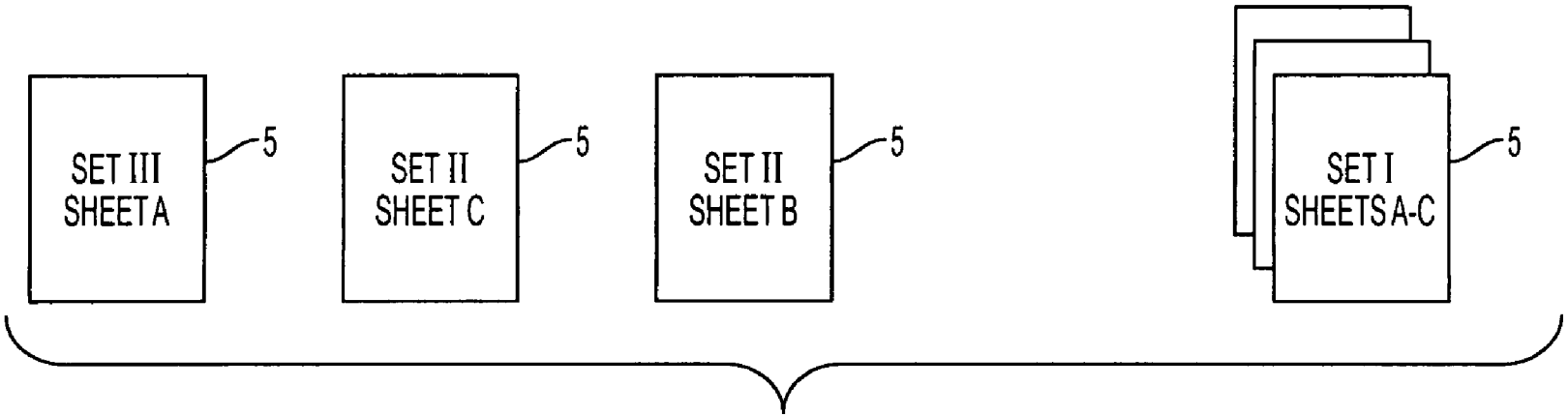
FIG. 8 illustrates a top view.
Figure 9:
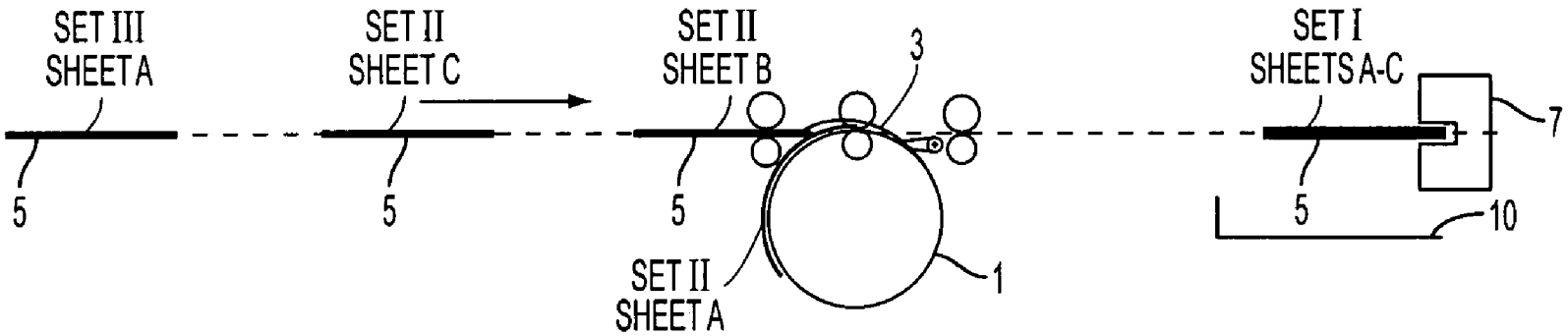
FIG. 9 illustrates a side view of the system where set II sheets are released by the disk fingers for travel toward the finishing station. The processing of set I is completed. The gate and finger are now in the inactive positions.
Figure 10:
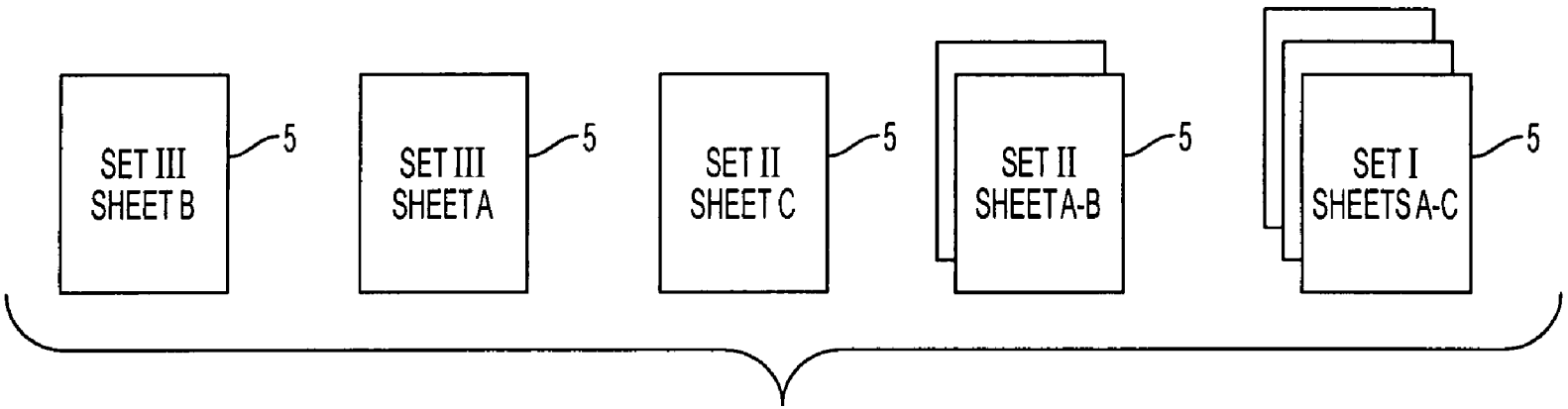
FIG. 10 illustrates a top view.
Figure 11:
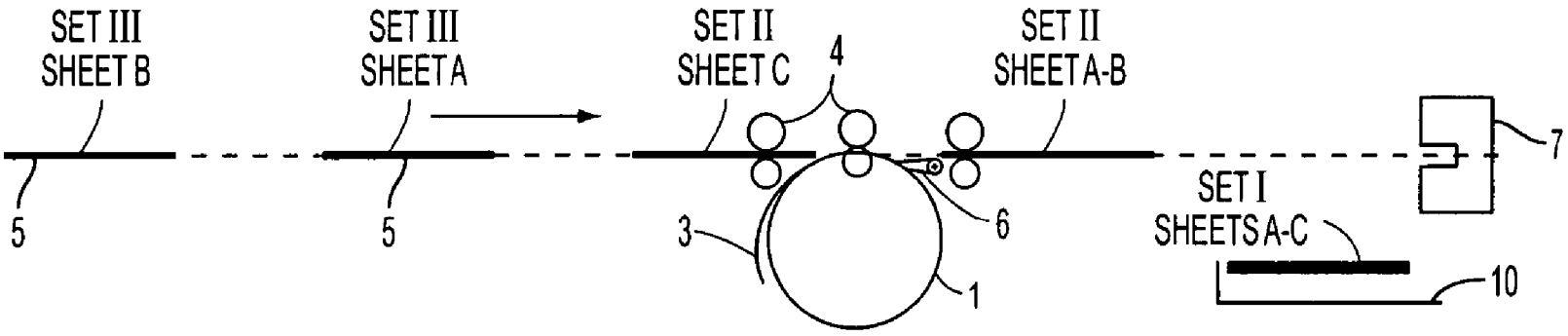
FIG. 11 a side view of the system illustrates the release of sheets of set II and III to resume travel toward the finishing station. The gate and finger are now in the inactive positions.
Figure 12:
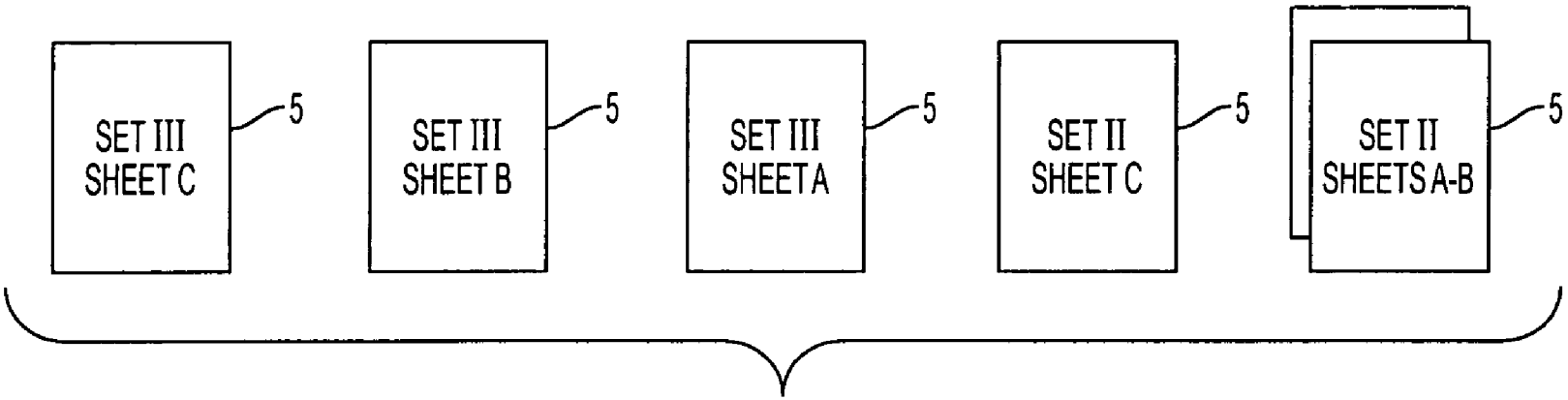
FIG. 12 illustrates a top view.
Figure 13:
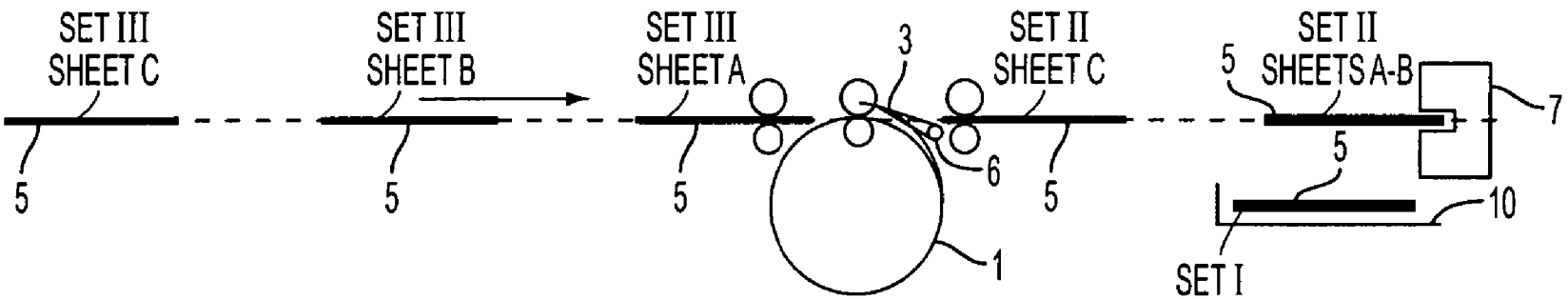
FIG. 13 a side view of the system where the sheets of set II are traveling toward or at the finishing station and papers of set III are now being buffered. The finger and gate are in the active positions.

In FIG. 9 all of set I (sheets A-C) are now compiled in the stapler or finishing area 7, as shown in the paper sequence of FIG. 8. Sheets A-B of set II are in the buffer. The buffer gate 6 in FIG. 9 is blocking access to path 2. The first sheet A of set II is in the buffer disk and the second sheet B of set II is entering finger 3 to be buffered. The first set I is now fully compiled and the stapler 7 and eject cycles can begin. If these functions require more time, then the next sheet could be buffered and the next after that, if needed. In FIG. 11, set I is now stacked and completed, sheets A-C of set II are approaching the finishing station 7 in the sequence shown in FIG. 10. This grouping of sheets is now traveling together down the path 2 toward stapler 7. In FIG. 13, the sheets 5 in the paper sequence of FIG. 12 continue their progress down the paper path 2. The gate 6 is activated and the buffer disk 1 is rotated ready to accept sheet A of set III. Sheets from set III are buffered until the previous set is completed, stapled, and then ejecting into the stacker tray 10. The cycle begins again as the next sheet 5 of the next set passes. It could now be easily shown that a 10 sheet set (or any other number) would follow the exact same process. The first sheet 5 (or sheets, if the stapling functions required more time) of each set would be buffered, temporarily taking the sheets 5 out of the normal paper path 2, holding them in the buffer, making time for the downstream functions and then being released back to the paper path 2. With this, the upstream device, the printer or copier, continues its cadence and never skips a pitch. Therefore, it remains at full productivity, the 120 prints per minute, in this example. However, the finishing device does have the benefits of time due to skipped pitched, since they are held by the buffer and then re-enter the paper path 2 as the finishing functions are being completed.

The above FIGS. 7 and 13 are in the "Buffering Mode". The buffering function is used as required. Typically, buffering is used to allow time for a downstream function to occur. Functions like stapling or set ejection can take more time than the inter-document time between sheets. Buffering can allow several pitch times. The upstream device, usually the processor or Image Output Terminal (IOT) is delivering sheets 5 at some rate. At 120 prints per minute, the rate is one sheet every 500 milliseconds. At 200 prints per minute, the rate is one sheet 5 every 300 milliseconds. The downstream functions like dual stapling and set ejection may require a whole second to accomplish. Buffering one to four sheets 5 can easily make up this time. The downstream functions can occur and the upstream rate continues with uninterrupted sheet processing. In the systems of all figures above described, the sequence and order of paper sets and sheets of FIG. 5 are shown in FIG. 4; the sequence of paper sets and sheets of FIG. 7 are shown in FIG. 6; the sequence of sets and sheets of FIG. 9 are shown in FIG. 8; the sequence of sets and sheets of FIG. 11 are shown in FIG. 10 and the sequence and order of sets and sheets in FIG. 13 are shown in FIG. 12.

It should be mentioned that although the present embodiments are described in relation to an electrostatic marking system, any suitable paper handling system can utilize the embodiments disclosed herein.

Figure 14:
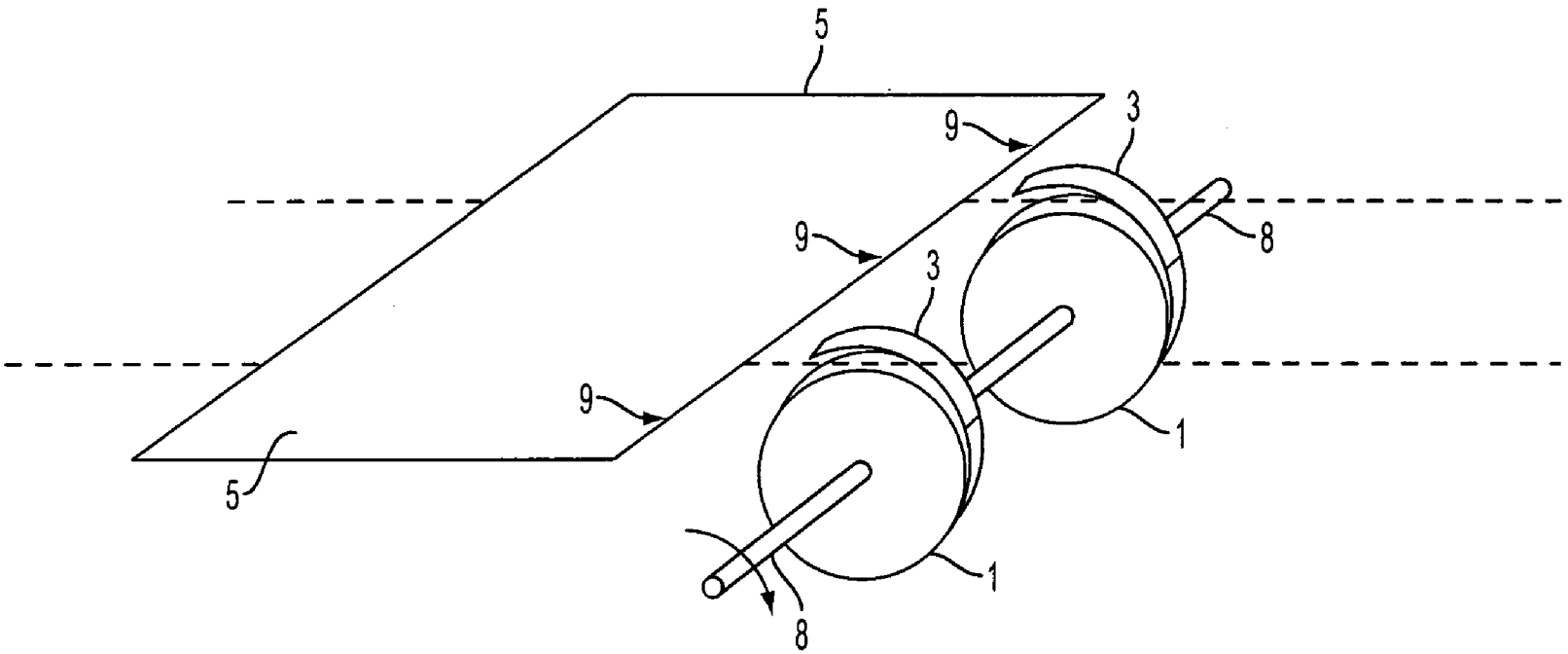
FIG. 14 illustrates a top-side view perspective of the disk with the fingers in the active position.

In FIG. 14 a disk 1 with collection fingers 3 is illustrated. Upon release of the paper stack 5 from the fingers 3, rollers 4 that are activated will pull the papers 5 from fingers 3 by contacting the paper in unfingered disk location 9.

By "Buffering Mode" is meant and used to allow time for a downstream function to occur. Functions in finishing station 7 like stapling or set ejection can take more time than the inter-document time between sheets 5. Buffering can allow several pitch times.

To summarize the above, the present embodiments provide a paper handling apparatus comprising a sheet buffering system, a system comprising in an operative arrangement a sheet transport, at least one rotable disk enabled to contact the transport, drive rollers adapted to move the sheet transport, at least one movable gate and at least one collection finger fixed to the disk. The disk is enabled to rotate to a position where the finger is in an open position and enabled to collect paper from the sheet transport. The disk also is enabled to rotate to a closed position where the finger is in a closed position and is enabled to discard the paper back on to the sheet transport. The finger is attached at a first end to the disk by a permanent attachment, and the finger has on a second end an open paper collecting portion enabled to scoop up and collect paper from and deposit paper onto the sheet transport. In this system the rotable disk is in operative contact with a lower surface of the transport, the finger is adapted to be moved to a surface above the transport, enabling thereby the finger to remove or scoop up paper from the transport during a sheet buffering process. In this embodiment, the gate is adapted to block access to and, alternately, to allow access to the sheet transport.

In the present embodiment, the drive rollers are enabled to be stalled or inactive while the system is in a sheet buffering collecting mode, and the drive rollers are enabled to be activated when the system is in a sheet transport mode. Also the gate is in a transport blocking position if the finger is in a sheet collecting mode, and is in a transport open mode when the finger is in a sheet dispensing mode.

The systems of these embodiments are adapted for use in a sheet marking apparatus. The system comprises in an operative arrangement a sheet(s) transport, a rotable disk, at least two drive rollers, at least one movable gate and at least one collection disk finger. The collection finger is attached at a first end to the disk and has at an opposite second end an open portion. This open portion is enabled to scoop up, remove and collect paper sheets off of the transport. The disk with the attached finger is adapted to rotate to a position relative to the transport where the finger in collection mode extends above the transport. It is enabled to remove paper sheets from the transport. The finger, when in a sheet dispensing mode, is adapted to be rotated below the transport. The gate is enabled to block access to the transport when the finger is in the collection mode. The gate is enabled to allow access to the transport when the finger is in sheet dispensing mode. This system is provided in an apparatus at a location prior to a finishing station. The rollers are located at a position along the transport different from the position of the disk along the transport. The open end of the finger points away from the transport when the finger is in a sheet dispensing mode. The open end of the finger is open and thereby points above the transport when the finger is in a sheet collecting mode. The gate extends above the transport and thereby is enabled to block access to the transport when the system is in a buffering or collection mode. The gate is positioned below and away from the transport when the system is in a finger sheet dispensing mode. Ultimately, a stack of buffered sheets are enabled to be dispensed from the finger, pass out to the transport, and finally to a sheet finishing station. The disk finger comprises an integrated leaf spring and is enabled to accommodate collection of a plurality of sheets.

The preferred and optimally preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A paper sheet handling system and apparatus comprising:

a sheet path or transport;

at least one rotable disk positioned along said path and enabled to contact said path and transport;

drive rollers adapted to move said transport;

at least one collection finger fixed at one end to an outside portion of said disk and having an open end away from said fixed end;

a movable gate adjacent said path adapted to block and also allow sheet access to said transport;

said disk enabled to rotate to a position where said finger is in an open position and enabled to collect paper from said sheet transport, and said disk enabled to rotate to a closed position where said finger is in a closed position and enabled to discharge said paper back onto said sheet transport;

said gate positioned beneath the transport when inactivated and movable into a path blocking location when activated, and when said finger is in a sheet collecting mode, said gate enabled to be in a transport open mode when said finger is in a sheet closed and dispensing mode, and said finger is open and points above said transport when said finger is in said sheet collecting mode, and wherein said gate is in a position to block access to said transport when said system is in a buffering or collection mode;

said drive rollers adapted to be in an inactive position while said finger is collecting said paper sheets and in an active position after said fingers have dispensed previously collected sheets back onto said transport, and wherein said finger is enabled to work in cooperation with and in unison with said gate in a blocking position and said drive rollers in an inactive position when said system is in a buffering or collection mode.

2. The system of claim 1 wherein said rotable disk is in operative contact with said transport and wherein said finger is adapted to be moved to a surface above said transport, to remove or scoop paper from said transport during a sheet buffering process and when said gate is in its active or blocking position.

3. The system of claim 1 wherein said gate is in a transport blocking position, said finger is in a sheet collecting position and said rollers are in an inactive position during said buffering process.

4. The system of claim 1 wherein said system is in an electrostatic marking system.

5. The system of claim 1 wherein the open end of said finger points away from said transport when said finger is in a sheet dispensing mode.

* * * * *